US009061177B1

(12) United States Patent
Singh

(10) Patent No.: US 9,061,177 B1
(45) Date of Patent: Jun. 23, 2015

(54) WRIST EXERCISE DEVICE

(71) Applicant: Ashok K. Singh, Ellicottcity, MD (US)

(72) Inventor: Ashok K. Singh, Ellicottcity, MD (US)

( * ) Notice: Subject to any disclaimer, the term of this patent is extended or adjusted under 35 U.S.C. 154(b) by 232 days.

(21) Appl. No.: 13/850,835

(22) Filed: Mar. 26, 2013

(51) Int. Cl.
*A63B 23/14* (2006.01)
*A63B 21/02* (2006.01)
*A63B 21/04* (2006.01)

(52) U.S. Cl.
CPC ..... *A63B 23/14* (2013.01)

(58) Field of Classification Search
CPC .... A63B 21/02; A63B 21/04; A63B 21/0421; A63B 21/0428; A63B 21/0435; A63B 21/0442; A63B 21/055; A63B 21/0552; A63B 23/12; A63B 23/129; A63B 23/14
USPC ..... 482/44–50, 92–94, 97–100, 121–124, 482/126, 129, 130, 133, 135–137, 905
See application file for complete search history.

(56) References Cited

U.S. PATENT DOCUMENTS 948,140 A * 2/1910 Johnson ..... 73/379.08
3,782,719 A * 1/1974 Kuhlman ..... 482/48
3,924,851 A 12/1975 Winston
4,155,547 A 5/1979 Savio et al.
4,351,523 A * 9/1982 Alexander ..... 482/123
4,770,409 A 9/1988 Wallisch
5,046,727 A 9/1991 Wilkinson et al.
5,613,927 A * 3/1997 Rothacker ..... 482/123
5,676,622 A 10/1997 McFarlane
5,738,613 A * 4/1998 Clayton ..... 482/47
5,839,992 A 11/1998 Phillips
5,967,947 A 10/1999 Glover
6,146,319 A 11/2000 Tarail
7,753,827 B1 7/2010 Emick
2011/0045953 A1* 2/2011 Poli ..... 482/48

* cited by examiner

*Primary Examiner* — Oren Ginsberg
(74) *Attorney, Agent, or Firm* — Richard L Miller

(57) ABSTRACT

A device that exercises a wrist of a user by converting a pivotal motion into a linear motion. The device includes a base, a pair of pivoting assemblies, a pair of resistance assemblies, and a grip. The base is placed on a support surface. The pair of pivoting assemblies extend upwardly from the base and are spaced apart from each other to have the wrist of the user placed therebetween. The pair of resistance assemblies depend from the pair of pivoting assemblies, respectively, to the base. The grip extends from one pivoting assembly to the other pivoting assembly and is gripped by a hand of the user, and when pivoted downwardly by the hand of the user, the pair of pivoting assemblies pivot downwardly which in turn causes the pair of resistance assemblies to extend linearly upwardly and provide a resistance, and in doing so, converts the pivotal motion into the linear motion.

66 Claims, 4 Drawing Sheets

WRIST EXERCISE DEVICE

1. BACKGROUND OF THE INVENTION

A. Field of the Invention

The embodiments of the present invention relate to a device for exercising a wrist of a user, and more particularly, the embodiments of the present invention relate to a device for exercising a wrist of a user by converting a pivotal motion into a linear motion.

B. Description of the Prior Art

Numerous innovations for wrist exercising devices have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a device for exercising a wrist of a user by converting a pivotal motion into a linear motion.

(1) U.S. Pat. No. 3,924,851 to Winston.

U.S. Pat. No. 3,924,851 issued to Winston on Dec. 9, 1975 in U.S. class 482 and subclass 105 teaches an exercise band worn about a user's wrist for varying exercise weights inserted in a band and a flap that is folded over openings of weight-receiving compartments thereof to thereby contain the weights in their compartments during an exercise routine. The flap also has a resilient and foam pad therein, which contributes to the comfort of wearing the band.

(2) U.S. Pat. No. 4,155,547 to Savio et al.

U.S. Pat. No. 4,155,547 issued to Savio et al. on May 22, 1979 in U.S. class 482 and subclass 46 teaches an arm exercising device for strengthening of the wrist, forearm, and elbow. The device includes a pair of longitudinally aligned and tubular members movable axially relative to each other. The movement is resisted by an adjustable spring force. A spring system has its length varied to adjust the tension, and thus the torsion of said spring system. One of the tubular members, preferably, is formed of a clear material in order that the adjustment can be visually observed.

(3) U.S. Pat. No. 4,770,409 to Wallisch.

U.S. Pat. No. 4,770,409 issued to Wallisch on Sep. 13, 1988 in U.S. class 482 and subclass 45 teaches a wrist exercise device that includes a figure eight shaped housing with circular portions, each of which has an annular channel therein. An arcuate slide is positioned within each channel, and a grip handle extends across the inner area of each circular portion and is connected to one of the arcuate slides. A stop is positioned in each channel, adjacent one end of each slide. A spring is positioned in each channel and extends between the stop and the other end of each arcuate slide.

(4) U.S. Pat. No. 5,046,727 to Wilkinson et al.

U.S. Pat. No. 5,046,727 issued to Wilkinson et al. on Sep. 10, 1991 in U.S. class 482 and subclass 45 teaches a wrist exercise device that includes a hollow shaft that houses a pair of compression springs. Tension disks are provided at the remote ends of the springs. The disks are moved toward and away from each other by turning a tension knob at one end of the device to increase or decrease the resistance from a pair of friction pads on each side of a handle at each end of the device. A resistance indicator is provided at one end of the device.

(5) U.S. Pat. No. 5,676,622 to McFarlane.

U.S. Pat. No. 5,676,622 issued to McFarlane on Oct. 14, 1997 in U.S. class 482 and subclass 45 teaches a wrist therapy device that includes a handle, a maze mounted to one end of the handle, an object for following the man, and a weight mounted to the handle between the handle and the maze. The user grasps the handle and moves the wrist to manipulate the maze so as to move the object along the maze. The maze may be a bent wire and the object a ring encircling the wire. Alternatively, the maze may be a bent tube filled with a viscous fluid and the object a ball within the tube.

(6) U.S. Pat. No. 5,839,992 to Phillips.

U.S. Pat. No. 5,839,992 issued to Phillips on Nov. 24, 1998 in U.S. class 482 and subclass 49 teaches a resilient wrist support and therapeutic hand exerciser device for supporting the wrist of a person performing repetitive tasks with their wrist, hand, and fingers, such as using a computer mouse and typing on a keyboard, and for exercising the muscles of the wrist, hand, fingers and forearm of the user. A mass of tiny glass spheres having the consistency and appearance of a fine powder is enclosed in a resilient inner bladder surrounded by a resilient outer bladder, and a thin layer of powder is disposed between the exterior surface of the inner bladder and interior surface of the outer bladder to prevent theme from sticking together, to reduce friction therebetween, and to allow relative sliding movement between the surfaces. The tiny spheres provide low resistance to relative particle movement by rolling on each other upon an increase or decrease in pressure applied to the device. When placed on a flat surface beneath the wrist of a user, the device deforms slightly and conforms to the underside of the user's wrist to form a comfortable cradle-like support as the downward pressure of the wrist increases or decreases. As the wrist is moved relative to the flat surface, the device smoothly rolls between the wrist and the flat surface to provide a smooth massaging effect on the wrist while maintaining wrist support. The resilient device can be squeezed in the palm of the hand to exercise the muscles of the hand, fingers, wrist, and forearm.

(7) U.S. Pat. No. 5,967,947 to Glover.

U.S. Pat. No. 5,967,947 issued to Glover on Oct. 19, 1999 in U.S. class 482 and subclass 91 teaches an isometric wrist exercise device that is useful for strengthening the wrist and for treating or alleviating symptoms associated with carpal tunnel syndrome. The device includes a wrist brace that adjustably encircles a user's wrist. The brace is attached to a swivel plate via a plurality of straps that extend forward from the wrist brace. The swivel plate is attached to an elongate strap with a wedge plate on its opposite end. The wedge plate can secure the elongate strap in a stationary position so that the user can place his wrist in therapeutic traction by pulling his arm against the stationary strap while selectively swiveling his wrist to find the optimum position.

(8) U.S. Pat. No. 6,146,319 to Tarail.

U.S. Pat. No. 6,146,319 issued to Tarail on Nov. 14, 2000 in U.S. class 482 and subclass 139 teaches an exercise grip and method for its use in coupling an object, such as a handle or a weight, to the hand of a user. The exercise grip has a body including a base portion with first and second opposing ends for retaining the handle or weight to the base portion. First and second strap portions are attached to and extend from opposite sides of the body along an axis of the body and are sized and shaped to extend around the back of the user's hand with the first strap portion extending between the thumb and forefinger of the user's hand and the second strap portion passing over the metacarpus region of the user's hand. The first and second strap portions meet and are attached to one another around the user's wrist.

(9) U.S. Pat. No. 7,753,827 to Emick.

U.S. Pat. No. 7,753,827 issued to Emick on Jul. 13, 2010 in U.S. class 482 and subclass 44 teaches a wrist roller exercise device that has a roller rod having opposite handle end portions, and which has a central portion, and has a spool carrier with a central balanced cable connection point. A cable is connected to the cable connection point and is also connected to an elevated frame member to secure and hold the carrier at a desired elevation above ground surface. A spool is attached on the central portion of the rod member with the rod member and the spool each being rotatable relative to the spool carrier. The spool also has a rope connection thereon. A rope that has a first rope end is attached to the rope connection and a second rope end that is connected to a weight object of desired mass. The cable supports the weight of the device so that a user can focus attention on forearm, wrist, hand, and finger muscles required to wind up the rope and to keep the device balanced on the cable and not on upper arm, shoulder, chest, and back muscles, which would otherwise be required to hold and suspend the device in the desired elevation above ground surface if not for the cable.

It is apparent that numerous innovations for wrist exercising devices have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a device for exercising a wrist of a user by converting a pivotal motion into a linear motion.

2. SUMMARY OF THE INVENTION

Thus, an object of the embodiments of the present invention is to provide a device for exercising a wrist of a user by converting a pivotal motion into a linear motion, which avoids the disadvantages of the prior art.

Briefly stated, another object of the embodiments of the present invention is to provide a device that exercises a wrist of a user by converting a pivotal motion into a linear motion. The device includes a base, a pair of pivoting assemblies, a pair of resistance assemblies, and a grip. The base is placed on a support surface. The pair of pivoting assemblies extend upwardly from the base and are spaced-apart from each other to have the wrist of the user placed therebetween. The pair of resistance assemblies depend from the pair of pivoting assemblies, respectively, to the base. The grip extends from one pivoting assembly to the other pivoting assembly and is gripped by a hand of the user, and when pivoted downwardly by the hand of the user, the pair of pivoting assemblies pivot downwardly which in turn causes the pair of resistance assemblies to extend linearly upwardly and provide a resistance, and in doing so, converts the pivotal motion into the linear motion.

The novel features considered characteristic of the embodiments of the present invention are set forth in the appended claims. The embodiments of the present invention themselves, however, both as to their constriction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

Figure 1:
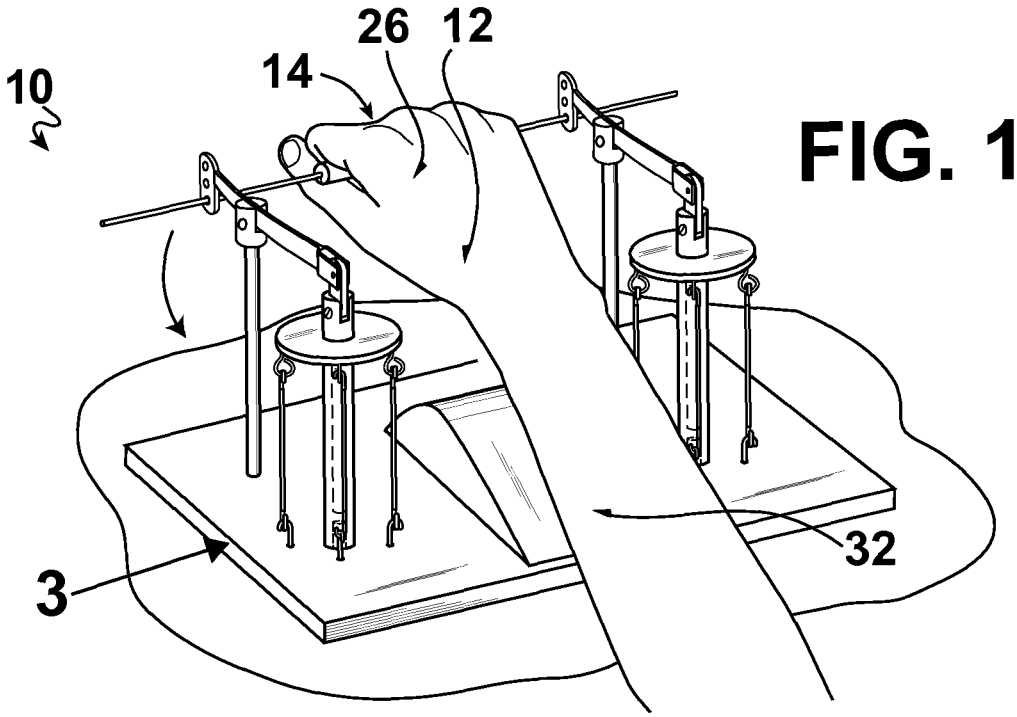
FIG. 1 is a diagrammatic perspective view of the device of the embodiments of the present invention exercising a wrist of a user by converting a pivotal motion into a linear motion, in use before the user has expended any energy into the device.

A. Introductory.

10 device of embodiments of present invention for exercising wrist 12 of user 14 by converting pivotal motion into linear motion

12 wrist of user 14

14 user

B. Configuration of Device 10.

16 base for placing on support surface 24

18 pair of pivoting assemblies for having wrist 12 of user 14 placed therebetween

20 pair of resistance assemblies

22 grip for being gripped by hand 26 of user 14

24 support surface

26 hand of user 14

C. Specific Configuration of Base 16.

28 platform of base 16 for resting on support surface 24

30 support rest of base 16 for supporting forearm 32 of user 14 resting thereon during use

32 forearm of user 14

D. Specific Configuration of Pair of Pivoting Assemblies 18.

34 post of each pivoting assembly of pair of pivoting assemblies 18

36 upper end of post 34 of each pivoting assembly of pair of pivoting assemblies 18

38 fulcrum of each pivoting assembly of pair of pivoting assemblies 18

40 top of fulcrum 38 of each pivoting assembly of pair of pivoting assemblies 18

42 slot of fulcrum 38 of each pivoting assembly of pair of pivoting assemblies 18

44 through bore of fulcrum 38 of each pivoting assembly of pair of pivoting assemblies 18

46 lever arm of each pivoting assembly of pair of pivoting assemblies 18

48 forward end of lever arm 46 of each pivoting assembly of pair of pivoting assemblies 18

50 back end of lever arm 46 of each pivoting assembly of pair of pivoting assemblies 18

52 through bore of lever arm 46 of each pivoting assembly of pair of pivoting assemblies 18

54 pivot pin of each pivoting assembly of pair of pivoting assemblies 18

56 head of forward end 48 of lever arm 46 of each pivoting assembly of pair of pivoting assemblies 18

58 plurality of through bores of head 56 of forward end 48 of lever arm 46 of each pivoting assembly of pair of pivoting assemblies 18

60 clevis of back end 50 of lever arm 46 of each pivoting assembly of pair of pivoting assemblies 18

E. Specific Configuration of Pair of Resistance Assemblies 20.

62 post of each resistance assembly of pair of resistance assemblies 20

64 upper end of post 62 of each resistance assembly of pair of resistance assemblies 20

65 hat of each resistance assembly of pair of resistance assemblies 20

66 brim of hat 65 of each resistance assembly of pair of resistance assemblies 20

68 crown of hat 65 of each resistance assembly of pair of resistance assemblies 20

70 disk-shaped brim of brim 66 of hat 65 of each resistance assembly of pair of resistance assemblies 20

72 blind bore of hat 65 of each resistance assembly of pair of resistance assemblies 20

74 clevis pin of clevis 60 of back end 50 of lever arm 46 of each pivoting assembly of pair of pivoting assemblies 18

76 resistance member subassemblies of each resistance assembly of pair of resistance assemblies 20

78 elastomer of each resistance member subassembly of resistance member subassemblies 76 of each resistance assembly of pair of resistance assemblies 20

80 eye of each resistance member subassembly of resistance member subassemblies 76 of each resistance assembly of pair of resistance assemblies 20

82 base hook of each resistance member subassembly of resistance member subassemblies 76 of each resistance assembly of pair of resistance assemblies 20

84 upper hook of each resistance member subassembly of resistance member subassemblies 76 of each resistance assembly of pair of resistance assemblies 20

86 upper end of elastomer 78 of each resistance member subassembly of resistance member subassemblies 76 of each resistance assembly of resistance member subassemblies 20

88 lower hook of each resistance member subassembly of resistance member subassemblies 76 of each resistance assembly of pair of resistance assemblies 20

90 lower end of elastomer 78 of each resistance member subassembly of resistance member subassemblies 76 of each resistance assembly of pair of resistance assemblies 20

F. Specific Configuration of Grip 22.

92 rod of grip 22

94 straight, slender, and elongated rod of rod 92 of grip 22

96 handle of grip 22

98 tubular handle of handle 96 of grip 22 for providing better grip for hand 26 of user 14

5. DETAILED DESCRIPTION OF THE PREFERRED EMBODIMENTS

A. Introductory.

Figure 2:
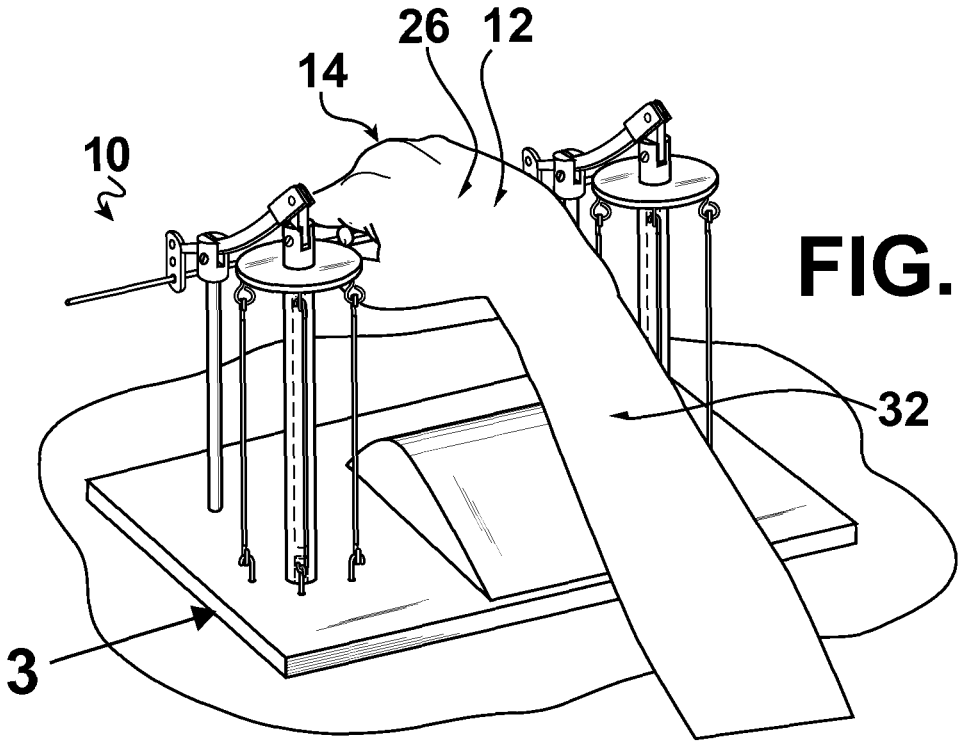
FIG. 2 is a diagrammatic perspective view of the device of the embodiments of the present invention exercising a wrist of a user by converting a pivotal motion into a linear motion, in use after the user has expended some energy into the device.

Referring now to the figures, in which like numerals indicate like parts, and particularly to FIGS. 1 and 2, which are, respectively, a diagrammatic perspective view of the device of the embodiments of the present invention exercising a wrist of a user by converting a pivotal motion into a linear motion, and a diagrammatic perspective view of the device of the embodiments of the present invention exercising a wrist of a user by converting a pivotal motion into a linear motion, the device of the embodiments of the present invention is shown generally at 10 for exercising a wrist 12 of a user 14 by converting a pivotal motion into a linear motion.

B. Configuration of the Device 10.

The configuration of the device 10 can best be seen in FIGS. 3 and 4, which are, respectively, a diagrammatic perspective view of the device of the embodiments of the present invention identified by ARROW 3 in FIGS. 1 and 2, and an enlarged diagrammatic side elevational view taken generally in the direction of ARROW 4 in FIG. 3, and as such, will be discussed with reference thereto.

The device 10 comprises a base 16, a pair of pivoting assemblies 18, a pair of resistance assemblies 20, and a grip 22.

The base 16 is for placing on a support surface 24. The pair of pivoting assemblies 18 extend upwardly from the base 16, and are spaced-apart from each other for having the wrist 12 of the user 14 placed therebetween. The pair of resistance assemblies 20 depend from the pair of pivoting assemblies 18, respectively, to the base 16. The grip 22 extends from one pivoting assembly 18 to the other pivoting assembly 18, and is for being gripped by a hand 26 of the user 14 (FIGS. 1 and 2), and when pivoted downwardly by the hand 26 of the user 14, the pair of pivoting assemblies 18 pivot downwardly which in turn causes the pair of resistance assemblies 20 to extend linearly upwardly and provide a resistance, and in doing so, converts the pivotal motion into the linear motion.

C. Specific Configuration of the Base 16.

The base 16 comprises a platform 28. The platform 28 of the base 16 is for resting on the support surface 24.

The base 16 further comprises a support rest 30.

The support rest 30 of the base 16 is disposed on the platform 28 of the base 16, between the pair of resistance assemblies 20.

The support rest 30 of the base 16 is ergonomically shaped for supporting a forearm 32 of the user 14 resting thereon during use (FIGS. 1 and 2).

D. Specific Configuration of the Pair of Pivoting Assemblies 18.

Each pivoting assembly 18 comprises a post 34.

The post 34 of each pivoting assembly 18 extends upwardly from the platform 28 of the base 16 to an upper end 36, are parallel to each other, and straddle the support rest 30 of the base 16.

Each pivoting assembly 18 further comprises a fulcrum 38.

The fulcrum 38 of each pivoting assembly 18 is disposed at the upper end 36 of the post 34 of an associated pivoting assembly 18.

The fulcrum 38 of each pivoting assembly 18 has a top 40 and a slot 42.

The slot 42 of the fulcrum 38 of each pivoting assembly 18 extends laterally thereacross, and depends from, and opens into, the top 40 of the fulcrum 38 of an associated assembly 18.

The fulcrum 38 of each pivoting assembly 18 further has a through bore 44.

The through bore 44 of the fulcrum 38 of each pivoting assembly 18 extends laterally thereacross, and communicates with the slot 42 of the fulcrum 38 of an associated pivoting assembly 18.

Each pivoting assembly 18 further comprises a lever arm 46.

The lever arm 46 of each pivoting assembly 18 has a forward end 48, a back end 50, and a through bore 52.

The through bore 52 of the lever arm 46 of each pivoting assembly 18 extends laterally therethrough, and is disposed closer to the back end 50 of the lever arm 46 of the associated pivoting assembly 18 than the forward end 48 of the lever arm 46 of the associated pivoting assembly 18 so as to provide a mechanical advantage.

The lever arm 46 of each pivoting assembly 18 rests pivotally in the slot 42 of the fulcrum 38 of an associated pivoting assembly 18, with the through bore 44 of the fulcrum 38 of the associated pivoting assembly 18 in alignment with the through bore 52 of the lever arm 46 of the associated pivoting assembly 18.

Each pivoting assembly 18 further comprises a pivot pin 54.

The pivot pin 54 of each pivoting assembly 18 extends through the through bore 44 of the fulcrum 38 of an associated pivoting assembly 18 and the through bore 52 of the lever arm 46 of the associated pivoting assembly 18 to thereby allow the lever arm 46 of each pivoting assembly 18 to pivot relative to the fulcrum 38 of the associated pivoting assembly 18.

The forward end 48 of the lever arm 46 of each pivoting assembly 18 extends downwardly, and forms a head 56.

The head 56 of the forward end 48 of the lever arm 46 of each pivoting assembly 18 has a plurality of through bores 58.

The plurality of through bores 58 of the head 56 of the forward end 48 of the lever arm 46 of each pivoting assembly 18 extends laterally therethrough, and are vertically spaced-apart.

The grip 22 extends through one through bore 58 of the head 56 of the forward end 48 of the lever arm 46 of one pivoting assembly 18 to a corresponding through bore 58 of the head 56 of the forward end 48 of the lever arm 46 of the other pivoting assembly 18.

The back end 50 of the lever arm 46 of each pivoting assembly 18 is bifurcated to form a clevis 60.

E. Specific Configuration of the Pair of Resistance Assemblies 20.

Figure 3:
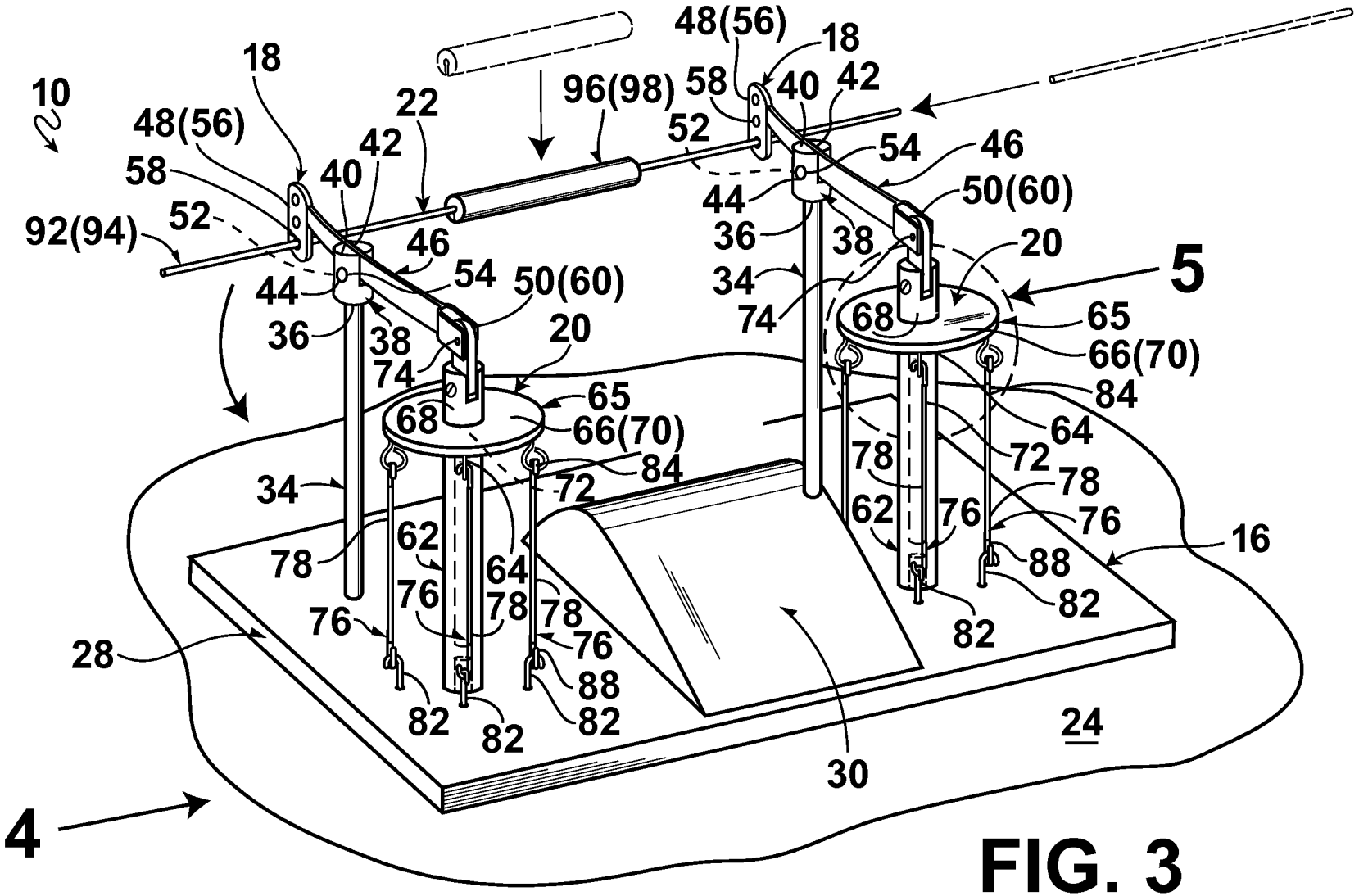
FIG. 3 is a diagrammatic perspective view of the device of the embodiments of the present invention identified by ARROW 3 in FIGS. 1 and 2.
Figure 4:
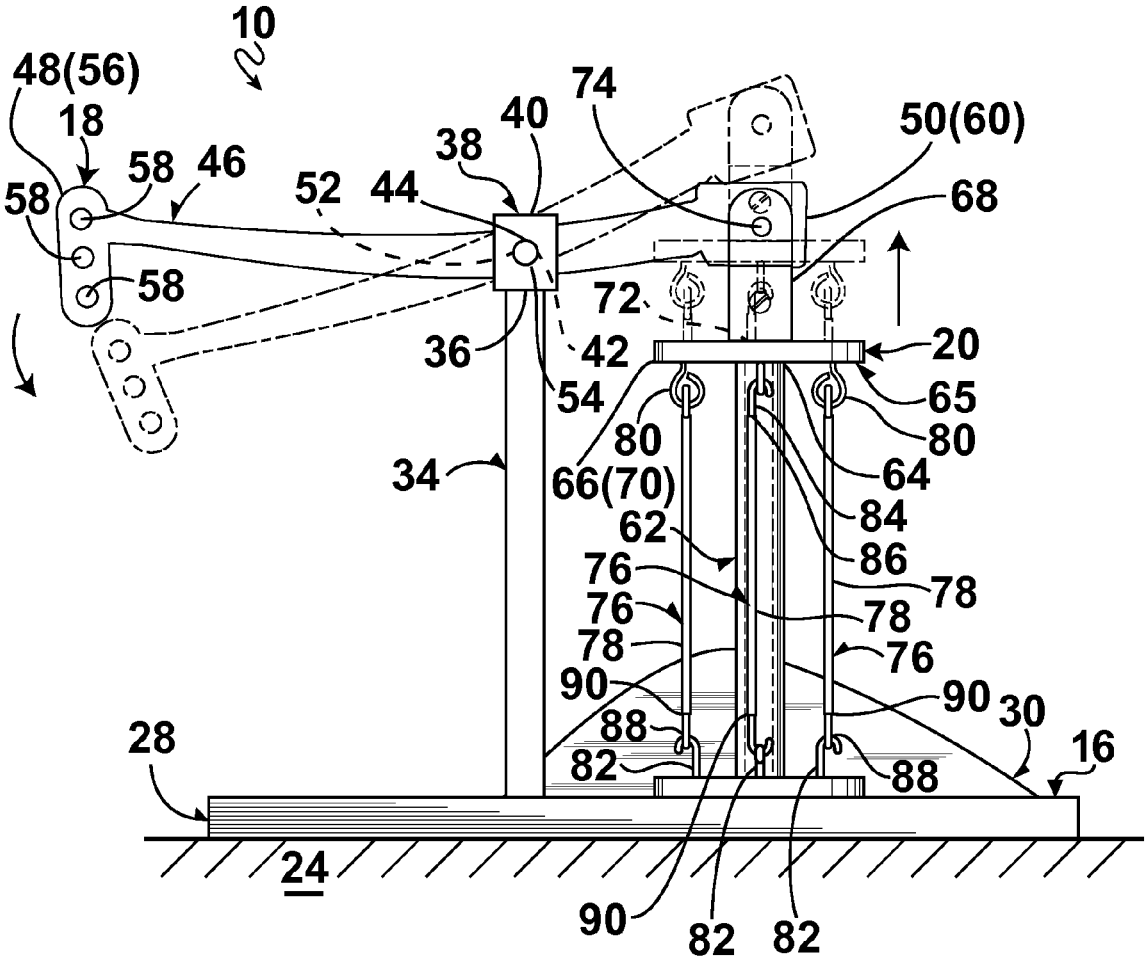
FIG. 4 is an enlarged diagrammatic side elevational view taken generally in the direction of ARROW 4 in FIG. 3.
Figure 5:
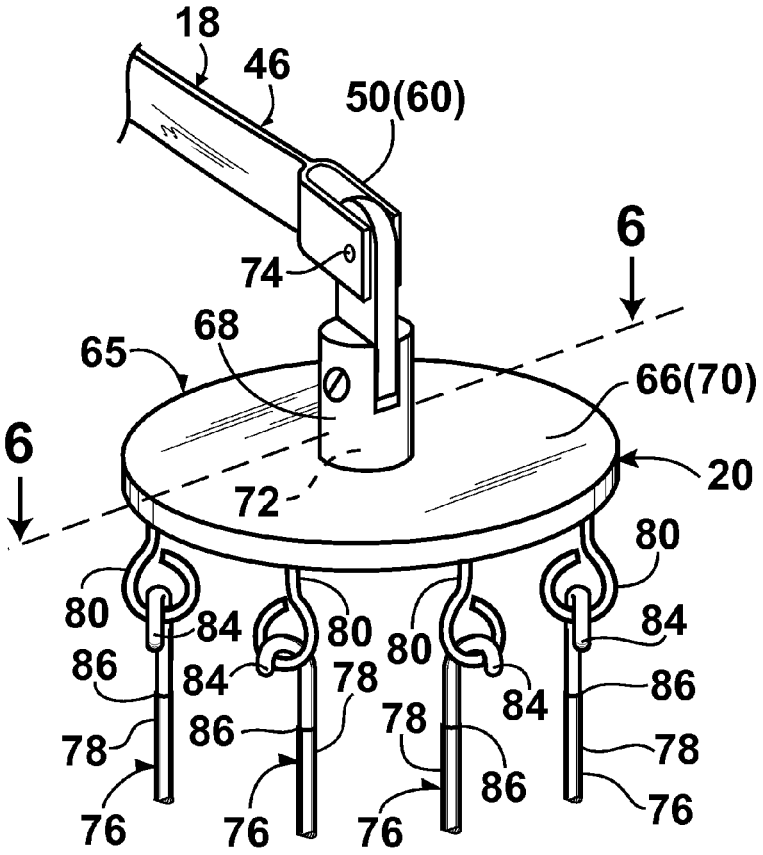
FIG. 5 is an enlarged diagrammatic perspective view of the area generally enclosed by the dotted curve identified by ARROW 5 in FIG. 3.
Figure 6:
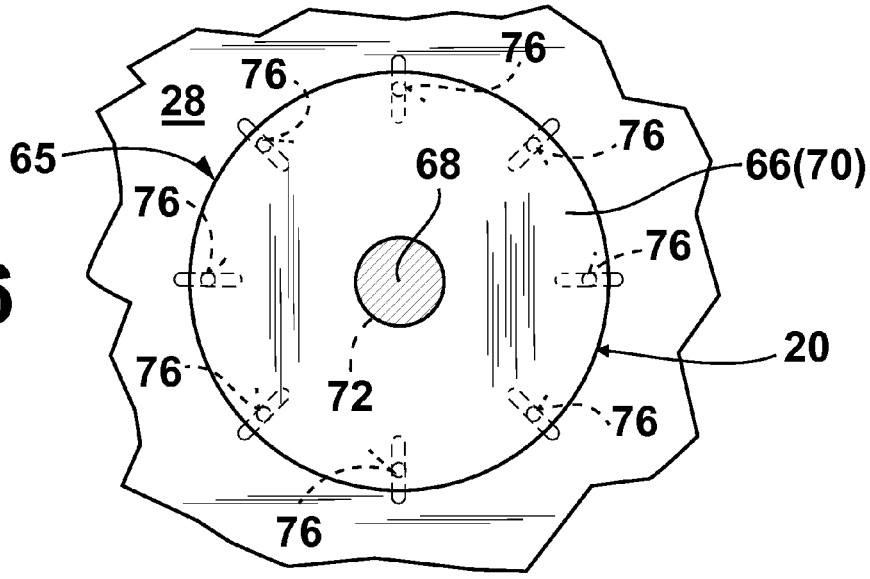
FIG. 6 is a diagrammatic partial cross sectional view taken along LINE 6-6 in FIG. 5, with parts broken away.

The specific configuration of the pair of resistance assemblies 20 can best be seen in FIGS. 3-6, which are, respectively, again, a diagrammatic perspective view of the device of the embodiments of the present invention identified by ARROW 3 in FIGS. 1 and 2, again, an enlarged diagrammatic side elevational view taken generally in the direction of ARROW 4 in FIG. 3, an enlarged diagrammatic perspective view of the area generally enclosed by the dotted curve identified by ARROW 5 in FIG. 3, and a diagrammatic cross sectional view taken along LINE 6-6 in FIG. 5, and as such, will be discussed with reference thereto.

Each resistance assembly 20 comprises a post 62.

The post 62 of each resistance assembly 20 extends upwardly from the platform 28 of the base 16 to an upper end 64, are parallel to each other, straddle the support rest 30 of the base 16, and are positioned behind, and in alignment with, the post 34 of the pair of pivoting assemblies 18, respectively.

Each resistance assembly 20 further comprises a hat 65.

The hat 65 of each resistance assembly 20 comprises a brim 66 and a crown 68.

The crown 68 of the hat 65 of each resistance assembly 20 extends coaxially upwardly from the brim 66 of the hat 65 of an associated resistance assembly 20.

The brim 66 of the hat 65 of each resistance assembly 20 is a disk-shaped brim 70.

The hat 65 of each resistance assembly 20 has a central blind bore 72.

The blind bore 72 of the hat 65 of each resistance assembly 20 slidably receives the upper end 64 of the post 62 of an associated resistance assembly 20 so as to allow the hat 65 of the associated resistance assembly 20 to ride up and down along the upper end 64 of the post 62 of the associated resistance assembly 20.

The clevis 60 of the back end 50 of the lever arm 46 of each pivoting assembly 18 pivotally receives the crown 68 of the hat 65 of an associated resistance assembly 20 so as the pair of pivoting assemblies 18 pivot, the hat 65 of an associated resistance assembly 20 rides up along the upper end 64 of the post 62 of the associated resistance assembly 20.

The clevis 60 of the back end 50 of the lever arm 46 of each pivoting assembly 18 is pivotally maintained to the crown 68 of the hat 65 of an associated resistance assembly 20 by a clevis pin 74.

Each resistance assembly 20 further comprises resistance member subassemblies 76.

Each resistance member subassembly 76 of each resistance assembly 20 comprises an elastomer 78.

The elastomer 78 of each resistance member subassembly 76 of each resistance assembly 20 depends from the disk-shaped brim 70 of the brim 66 of the hat 65 of an associated resistance assembly 20 to the platform 28 of the base 16 so when the grip 22 is gripped by the hand 26 of the user 14 and pivoted downwardly, the pair of pivoting assemblies 18 pivot downwardly which in turn causes the hat 65 of each resistance assembly 20 to ride up along the upper end 64 of the post 62 of the associated resistance assembly 20 under the resistance of the elastomer 78 of each resistance member subassembly 76 of the associated resistance assembly 20.

Each resistance member subassembly 76 of each resistance assembly 20 further comprises an eye 80.

The eye 80 of each resistance member subassembly 76 of each resistance assembly 20 depends from the disk-shaped brim 70 of the brim 66 of the hat 65 of an associated resistance assembly 20.

Each resistance member subassembly 76 of each resistance assembly 20 further comprises a base hook 82.

The base hook 82 of each resistance member subassembly 76 of each resistance assembly 20 extends upwardly from the platform 28 of the base 16, and is in alignment with the eye 80 of an associated resistance member subassembly 76 of an associated resistance assembly 20.

Each resistance member subassembly 76 of each resistance assembly 20 further comprises an upper hook 84.

The upper hook 84 of each resistance member subassembly 76 of each resistance assembly 20 is disposed on an upper end 86 of the elastomer 78 of an associated resistance member subassembly 76 of an associated resistance assembly 20, and replaceably engages in the eye 80 of the associated resistance member subassembly 76 of the associated resistance assembly 20.

Each resistance member subassembly 76 of each resistance assembly 20 further comprises a lower hook 88.

The lower hook 88 of each resistance member subassembly 76 of each resistance assembly 20 is disposed on a lower end 90 of the elastomer 78 of an associated resistance member subassembly 76 of an associated resistance assembly 20, and replaceably engages in the base hook 82 of the associated resistance member subassembly 76 of the associated resistance assembly 20 so as to allow the elastomer 78 of each resistance member subassembly 76 of each resistance assembly 20 to be removed and changed for varying the resistance.

F. Specific Configuration of the Grip 22.

The specific configuration of the grip 22 can best be seen in FIG. 3, which is, again, a diagrammatic perspective view of the device of the embodiments of the present invention identified by ARROW 3 in FIGS. 1 and 2, and as such, will be discussed with reference thereto.

The grip 22 comprises a rod 92.

The rod 92 of the grip 22 is a straight, slender, and elongated rod 94.

The straight, slender, and elongated rod 94 of the rod 92 of the grip 22 extends through one through bore 58 of the head 56 of the forward end 48 of the lever arm 46 of one pivoting assembly 18 to a corresponding through bore 58 of the head 56 of the forward end 48 of the lever arm 46 of the other pivoting assembly 18.

The grip 22 further comprises a handle 96.

The handle 96 of the grip 22 is a tubular handle 98.

The tubular handle 98 of the handle 96 of the grip 22 coaxially receives the straight, slender, and elongated rod 94 of the rod 92 of the grip 22, and is disposed between the pair of pivoting assemblies 18 for providing a better grip for the hand 26 of the user 14.

G. Impressions.

It will be understood that each of the elements described above or two or more together may also find a useful application in other types of constructions differing from the types described above.

While the embodiments of the present invention have been illustrated and described as embodied in a device for exercising a wrist of a user by converting a pivotal motion into a linear motion, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A device for exercising a wrist of a user by converting a pivotal motion into a linear motion, comprising:

a) a base;

b) a pair of pivoting assemblies;

c) a pair of resistance assemblies; and d) a grip;

wherein said base is for placing on a support surface;

wherein said pair of pivoting assemblies extend upwardly from said base;

wherein said pair of pivoting assemblies are spaced apart from each other for having the wrist of the user placed therebetween;

wherein said pair of resistance assemblies depend from said pair of pivoting assemblies, respectively, to said base;

wherein said grip extends from one pivoting assembly to the other pivoting assembly; and wherein said grip is for being gripped by a hand of the user, and when pivoted downwardly by the hand of the user, said pair of pivoting assemblies pivot downwardly which in turn causes said pair of resistance assemblies to extend linearly upwardly and provide a resistance, and in doing so, converts the pivotal motion into the linear motion.

2. The device of claim 1, wherein said base comprises a platform; and wherein said platform of said base is for resting on the support surface.

3. The device of claim 2, wherein said base comprises a support rest.

4. The device of claim 3, wherein said support rest of said base is disposed on said platform of said base.

5. The device of claim 4, wherein said support test of said base is disposed between said pair of resistance assemblies.

6. The device of claim 3, wherein said support test of said base is ergonomically shaped for supporting a forearm of the user resting thereon during use.

7. The device of claim 3, wherein each pivoting assembly comprises a post.

8. The device of claim 7, wherein said post of each pivoting assembly extends upwardly from said platform of said base to an upper end.

9. The device of claim 8, wherein each pivoting assembly comprises a fulcrum.

10. The device of claim 9, wherein said fulcrum of each pivoting assembly is disposed at said upper end of said post of an associated pivoting assembly.

11. The device of claim 9, wherein said fulcrum of each pivoting assembly has a slot.

12. The device of claim 11, wherein said slot of said fulcrum of each pivoting assembly extends laterally thereacross.

13. The device of claim 11, wherein said fulcrum of each pivoting assembly has a top; and wherein said slot of said fulcrum of each pivoting assembly depends from, and opens into, said top of said fulcrum of an associated pivoting assembly.

14. The device of claim 11, wherein said fulcrum of each pivoting assembly has a through bore.

15. The device of claim 14, wherein said through bore of said fulcrum of each pivoting assembly extends laterally thereacross.

16. The device of claim 14, wherein said through bore of said fulcrum of each pivoting assembly communicates with said slot of said fulcrum of an associated pivoting assembly.

17. The device of claim 14, wherein each pivoting assembly comprises a lever arm.

18. The device of claim 17, wherein said lever arm of each pivoting assembly has a through bore.

19. The device of claim 18, wherein said through bore of said lever arm of each pivoting assembly extends laterally therethrough.

20. The device of claim 18, wherein said lever arm of each pivoting assembly has:

a) a forward end; and b) a back end; and wherein said through bore of said lever arm of each pivoting assembly is disposed closer to said back end of said lever arm of an associated pivoting assembly than said forward end of said lever arm of said associated pivoting assembly so as to provide a mechanical advantage.

21. The device of claim 20, wherein said forward end of said lever arm of each pivoting assembly extends downwardly, and forms a head.

22. The device of claim 21, wherein said head of said forward end of said lever arm of each pivoting assembly has a plurality of through bores.

23. The device of claim 22, wherein said plurality of through bores of said head of said forward end of said lever arm of each pivoting assembly extend laterally therethrough.

24. The device of claim 22, wherein said plurality of through bores of said head of said forward end of said lever arm of each pivoting assembly are vertically spaced-apart.

25. The device of claim 22, wherein said grip extends through one through bore of said head of said forward end of said lever arm of one pivoting assembly to through a corresponding through bore of said head of said forward end of said lever arm of the other pivoting assembly.

26. The device of claim 22, wherein said grip comprises a rod.

27. The device of claim 26, wherein said rod of said grip is a straight, slender, and elongated rod.

28. The device of claim 27, wherein said straight, slender, and elongated rod of said rod of said grip extends through one through bore of said head of said forward end of said lever arm of one pivoting assembly to a corresponding through bore of said head of said forward end of said lever arm of the other pivoting assembly.

29. The device of claim 27, wherein said grip comprises a handle.

30. The device of claim 29, wherein said handle of said grip is a tubular handle.

31. The device of claim 30, wherein said tubular handle of said handle of said grip coaxially receives said straight, slender, and elongated rod of said rod of said grip.

32. The device of claim 30, wherein said tubular handle of said handle of said grip is disposed between said pair of pivoting assemblies for providing a better grip for the hand of the user.

33. The device of claim 20, wherein said back end of said lever arm of each pivoting assembly is bifurcated to form a clevis.

34. The device of claim 33, wherein each resistance assembly comprises a post.

35. The device of claim 34, wherein said post of each resistance assembly extends upwardly from said platform of said base to an upper end.

36. The device of claim 35, wherein each resistance assembly comprises a hat.

37. The device of claim 36, wherein said hat of each resistance assembly comprises:

a) a brim; and b) a crown.

38. The device of claim 37, wherein said crown of said hat of each resistance assembly extends coaxially upwardly from said brim of said hat of an associated resistance assembly.

39. The device of claim 37, wherein said brim of said hat of each resistance assembly is a disk-shaped brim.

40. The device of claim 39, wherein each resistance assembly comprises resistance member subassemblies.

41. The device of claim 40, wherein each resistance member subassembly of each resistance assembly comprises an elastomer.

42. The device of claim 41, wherein said elastomer of each resistance member subassembly of each resistance assembly depends from said disk-shaped brim of said brim of said hat of an associated resistance assembly to said platform of said base so when said grip is gripped by the hand of the user and pivoted downwardly, said pair of pivoting assemblies pivot downwardly which in turn causes said hat of each resistance assembly to ride up along said upper end of said post of said associated resistance assembly under resistance of said elastomer of said associated resistance member subassembly of said associated resistance assembly.

43. The device of claim 41, wherein each resistance member subassembly of each resistance assembly comprises an eye.

44. The device of claim 43, wherein said eye of each resistance member subassembly of each resistance assembly depends from said disk-shaped brim of said brim of said hat of an associated resistance assembly.

45. The device of claim 43, wherein each resistance member subassembly of each resistance assembly comprises a base hook.

46. The device of claim 45, wherein said base hook of each resistance member subassembly of each resistance assembly extends upwardly from said platform of said base.

47. The device of claim 45, wherein said base hook of each resistance member subassembly of each resistance assembly is in alignment with said eye of an associated resistance member subassembly of an associated resistance assembly.

48. The device of claim 45, wherein each resistance member subassembly of each resistance assembly comprises a lower hook.

49. The device of claim 48, wherein said lower hook of each resistance member subassembly of each resistance assembly is disposed on a lower end of said elastomer of an associated resistance member subassembly of an associated resistance assembly.

50. The device of claim 48, wherein said lower hook of each resistance member subassembly of each resistance assembly replaceably engages in said base hook of an associated resistance member subassembly of an associated resistance assembly so as to allow said elastomer of said associated resistance member subassembly of said resistance assembly to be removed and changed for varying the resistance.

51. The device of claim 43, wherein each resistance member subassembly of each resistance assembly comprises an upper hook.

52. The device of claim 51, wherein said upper hook of each resistance member subassembly of each resistance assembly is disposed on an upper end of said elastomer of an associated resistance member subassembly of an associated resistance assembly.

53. The device of claim 51, wherein said upper hook of each resistance member subassembly of each resistance assembly replaceably engages in said eye of an associated resistance member subassembly of an associated resistance assembly.

54. The device of claim 37, wherein said clevis of said back end of said lever arm of each pivoting assembly pivotally receives said crown of said hat of an associated resistance assembly so as said pair of pivoting assemblies pivot, said hat of an associated resistance assembly rides up along said upper end of said post of said associated resistance assembly.

55. The device of claim 37, wherein said clevis of said back end of said lever arm of each pivoting assembly is pivotally maintained to said crown of said hat of an associated resistance assembly by a clevis pin.

56. The device of claim 36, wherein said hat of each resistance assembly has a central blind bore.

57. The device of claim 56, wherein said blind bore of said hat of each resistance assembly slidably receives said upper end of said post of an associated resistance assembly so as to allow said hat of said associated resistance assembly to ride up and down along said upper end of said post of said associated resistance assembly.

58. The device of claim 34, wherein said post of each resistance assembly are parallel to each other.

59. The device of claim 34, wherein said post of each resistance assembly straddle said support rest of said base.

60. The device of claim 34, wherein said post of each resistance assembly are positioned behind said post of said pair of pivoting assemblies, respectively.

61. The device of claim 34, wherein said post of each resistance assembly are positioned in alignment with said post of said pair of pivoting assemblies, respectively.

62. The device of claim 18, wherein said lever arm of each pivoting assembly rests pivotally in said slot of said fulcrum of an associated pivoting assembly; and wherein said through bore of said fulcrum of said associated pivoting assembly is in alignment with said through bore of said lever arm of said associated pivoting assembly.

63. The device of claim 18, wherein each pivoting assembly comprises a pivot pin.

64. The device of claim 63, wherein said pivot pin of each pivoting assembly extends through said through bore of said fulcrum of an associated pivoting assembly and said through bore of said lever arm of said associated pivoting assembly to thereby allow said lever arm of each pivoting assembly to pivot relative to said fulcrum of said associated pivoting assembly.

65. The device of claim 7, wherein said post of each pivoting assembly are parallel to each other.

66. The device of claim 7, wherein said post of each pivoting assembly straddle said support rest of said base.

* * * * *